US007175755B2

(12) United States Patent
de Souza

(10) Patent No.: US 7,175,755 B2
(45) **Date of Patent: *Feb. 13, 2007**

(54) PROCESS FOR THE EXTRACTIVE OXIDATION OF CONTAMINANTS FROM RAW HYDROCARBON STREAMS

(75) Inventor: Wladmir Ferraz de Souza, Rio de Janeiro (BR)

(73) Assignee: Petroleo Brasileiro S.A.-Petrobras, Rio de Janeiro (BR)

( * ) Notice: Subject to any disclaimer, the term of this patent is extended or adjusted under 35 U.S.C. 154(b) by 454 days.

This patent is subject to a terminal disclaimer.

(21) Appl. No.: 10/429,843
(22) Filed: May 6, 2003

(65) Prior Publication Data

US 2004/0222134 A1 Nov. 11, 2004

(51) Int. Cl.
*C10G 29/20* (2006.01)

(52) U.S. Cl. ..... 208/237; 208/219; 208/222; 208/244; 208/254 R; 208/255; 208/256; 208/295; 208/299

(58) Field of Classification Search ..... 208/219, 208/222, 244, 254 R, 255, 256, 295, 299, 208/237; 588/316
See application file for complete search history.

(56) References Cited

U.S. PATENT DOCUMENTS 2,591,946 A 4/1952 Krause et al.

(Continued)

FOREIGN PATENT DOCUMENTS

EP 0 565 324 A1 10/1993

OTHER PUBLICATIONS

K. M. Brown et al., "Low-cost way to treat high-mercaptan gasoline". The Oil and Gas Journal, Oct. 26, 1959, v. 57, n44, pp. 73-78.

(Continued)

*Primary Examiner*—Glenn Caldarola
*Assistant Examiner*—Prem C. Singh
(74) *Attorney, Agent, or Firm*—Sughrue Mion, PLLC

(57) ABSTRACT

A process for the extractive oxidation of contaminants from raw hydrocarbon streams rich in heteroatomic polar compounds is described, the said process involving the extractive oxidation of sulfur and nitrogen compounds from said streams, the said process comprising treating said streams with a peroxide solution/organic acid couple, the weight percent of the peroxide solution and organic acid based on raw hydrocarbon being at least 3 for both the peroxide and organic acid solution, under an acidic pH, atmospheric or higher pressure and ambient or higher temperature. As a result of the reaction, the oxidized heteroatomic compounds, having strong affinity for the aqueous phase, are extracted into said aqueous phase, while the oxidized hydrocarbon is neutralized, water washed and dried, the resulting end product being a hydrocarbon stream from which have been removed 88.1 wt % or more of total nitrogen compounds and basic nitrogen up to 99.1 wt %, both calculated as mass contents, total Sulfur 23.3% removal, and removal of total olefins is limited to 6.5 weight %. The treated product is further directed to any refining process.

28 Claims, 3 Drawing Sheets

U.S. PATENT DOCUMENTS

| | | | | |
|---|---|---|---|---|
| 2,804,473 | A | 8/1957 | Phillips et al. | |
| 3,847,800 | A | 11/1974 | Guth et al. | |
| 5,310,479 | A | 5/1994 | Audeh | |
| 5,917,049 | A | 6/1999 | Suverkropp et al. | |
| 6,406,616 | B1 | 6/2002 | Rappas et al. | |
| 6,459,011 | B1 * | 10/2002 | Tarr et al. | 588/316 |
| 6,544,409 | B2 * | 4/2003 | De Souza | 208/208 R |
| 2002/0189975 | A1 | 12/2002 | De Souza | |

OTHER PUBLICATIONS

D. Chapados, et al., "Desulfurization By Selective Oxidation and Extraction of Sulfur-Containing Compounds to Economically Achieve Ultra-Low Proposed Diesel Fuel Sulfur Requirements", NPRA, Mar. 26-28, 2000.

* cited by examiner

PROCESS FOR THE EXTRACTIVE OXIDATION OF CONTAMINANTS FROM RAW HYDROCARBON STREAMS

FIELD OF THE INVENTION

The present invention relates to a process for the extractive oxidation of raw hydrocarbon streams, which comprises oxidizing and extracting contaminants such as heteroatomic polar compounds, while unsaturated moieties are oxidized to a much lesser degree. The said contaminants are oxidized in the presence of an aqueous oxidant mixture of a peroxide and an organic acid, the weight percent of the peroxide solution and organic acid based on raw hydrocarbon being at least 3, the contaminants being simultaneously removed from said streams by the aqueous oxidant itself, the process occurring in a single reactor under atmospheric or higher pressure. More specifically, the present invention relates to a process for the removal and/or inertization of contaminants the presence of which causes odor and color instability, as well as turbidity in raw hydrocarbon streams rich in said heteroatomic polar compounds, including raw naphthas such as those from thermal processes such as delayed coking, fluid catalytic cracking as well as from shale oil retorting processes or other chemical processes, which enhance the polarity of said heteroatomic polar compounds. The contaminants include nitrogen and sulfur compounds. The removal of total nitrogen compounds from shale oil naphtha as mass contents reaches 88.1 weight % and basic nitrogen up to 99.1 weight %. Total olefins removal does not exceed 6.5 weight % therefore does not affect the octane index substantially. Sulfur compounds, which contaminate raw naphtha, are converted into oxidized compounds such as sulfoxides or sulfones, which are nearly odorless, and are partly removed by the aqueous oxidant mixture, leading to the removal of at least 23 weight % of such sulfur compounds.

BACKGROUND INFORMATION

Extractive oxidation used as a naphtha treating process is well-known, for example, the sweetening naphtha process, typically comprising a catalytic oxidation via $O_2$ in the presence of NaOH or KOH of odor-generating mercaptans of certain raw naphthas, more specifically those from fluid catalytic cracking. See U.S. Pat. No. 2,591,946 where is taught a sweetening process for sour oils whereby mercaptans are removed from said oils by carrying out a reaction the catalyst of which is KOH, $O_2$ and 0.004 to 0.1 wt % copper oxide based on the KOH solution.

Also, an article in the Oil and Gas Journal vol. 57 (44) p. 73–78 (1959) entitled "Low Cost Way to Treat High-Mercaptan Gasoline" by K. M. Brown et al, is directed to the discussion of the Merox process and other prior art procedures.

Also, an oxidizing/extracting process is reported in U.S. Pat. No. 6,406,616, said process being exclusively focused on the removal of up to 500–600 ppm sulfur from gasoline streams as exemplified therein, the oxidation reaction being performed by a mixture of peroxide and formic acid. One alternative presented is a self-extractive oxidation process and another one includes a further adsorption step over an alumina bed.

However, such state-of-the-art processes do not apply to highly contaminated raw naphthas such as those having sulfur contents of 8000 ppm or more, nitrogen contents of 2000 ppm or more, including other unstable compounds, which cause rapid self-degradation of the stream. More specifically such state-of-the-art processes are exclusively applied to remove or to sweeten sulfur-containing compounds. Particularly, said processes are not suitable to removing or stabilizing non-sulfur compounds, for instance substances containing nitrogen functionalities. Among those, should be mentioned mainly those nitrogen functionalities of a basic character, which cause not only odor but also naphtha instabilities due to color as well as turbidity. Besides, those basic nitrogen substances are harmful to the hydrodesulfurization treatment processes used as naphtha finishing processes before commercialization.

The peroxide-aided oxidation is a promising path for the refining of fossil oils, and may be directed to several goals, for example to the removal of sulfur and nitrogen compounds present in fossil hydrocarbon streams, mainly those used as fuels for which the international specification as for the sulfur content becomes more and more stringent.

One further application is the withdrawal of said compounds from streams used in processes such as hydrotreatment, where the catalyst may be deactivated by the high contents in nitrogen compounds.

Basically, the peroxide oxidation converts the sulfur and nitrogen impurities into higher polarity compounds, those having a higher affinity for polar solvents relatively immiscible with the hydrocarbons contaminated by the sulfur and nitrogen compounds. This way, the treatment itself comprises an oxidation reaction step followed by a separation step of the oxidized products by polar solvent extraction and/or adsorption and/or distillation.

The oxidation reaction step using peroxides, as well as the separation steps of the oxidized compounds from the hydrocarbons have been the object of various researches.

Thus, EP 0565324A1 teaches a technique exclusively focused on the withdrawal of organic sulfur from petroleum, shale oil or coal having an oxidation reaction step with an oxidizing agent like $H_2O_2$ initially at 30° C. and then heated at 50° C. in the presence of an organic acid (for example HCOOH or AcOH) dispensing with catalysts, followed by (a) a solvent extraction step, such as N,N'-dimethylformamide, dimethylsulfoxide, N,N'-dimethylacetamide, N-methylpyrrolidone, acetonitrile, trialkylphosphates, methyl alcohol, nitromethane among others; or by (b) an adsorption step with alumina or silica gel, or (c) a distillation step where the improved separation yields are caused by the increase in boiling point of the sulfur oxidized compounds.

A similar treatment concept is used by D. Chapados et al in "Desulfurization by Selective Oxidation and Extraction of Sulfur-Containing Compounds to Economically Achieve Ultra-Low Proposed Diesel Fuel Sulfur Requirements", NPRA 2000 Annual Meeting, Mar. 26–28, 2000, San Antonio, Tex., Paper AM-00-25 directed to a refining process also focused on the reduction of the sulfur content in oils, the oxidation step occurring at temperatures below 100° C. and atmospheric pressures, followed by a polar solvent extraction step and by an adsorption step. The authors further suggest the use of a solvent recovery unit and another one for the biological treatment of the concentrate (extracted oxidized products) from the solvent recovery unit, this unit converting said extracted oxidized products into hydrocarbons.

According to the cited reference by Chapados et al., the reaction phase consists of an oxidation where a polarized —O—OH moiety of a peracid intermediate formed from the reaction of hydrogen peroxide and an organic acid performs an electrophilic oxidation of the sulfur compounds, basically sulfides such as benzothiophenes and dibenzothiophenes and their alkyl-related compounds so as to produce sulfoxides and sulfones.

U.S. Pat. No. 3,847,800 teaches that the oxidation of nitrogen compounds, such as the quinolines and their alkyl-related compounds so as to produce N-oxides (or nitrones) can be promoted as well when reacting these compounds with a nitrogen oxide.

The mechanisms for the oxidation of sulfur containing compounds with a peracid derived from a peroxide/organic acid couple are shown in FIG. 1 attached, with dibenzothiophene taken as model compound.

According to U.S. Pat. No. 2,804,473, the oxidation of amines with an organic peracid leads to N-oxides, therefore a reaction pathway analogous to that of sulfur-containing compound is expected for the oxidation of nitrogen-containing compounds with a peracid derived from the peroxide/organic acid couple, as shown in FIG. 2 attached, with quinoline taken as model compound. In addition, the same US patent teaches a process for the production of lower aliphatic peracids. According to this publication, peracids are useful in a variety of reactions, such as oxidation of unsaturated compounds to the corresponding alkylene oxide derivatives or epoxy compounds.

As illustrated in FIG. 3 attached, it is also well-known that hydrogen peroxide naturally decomposes into unstable intermediates that yield $O_2$ and $H_2O$, such process being accelerated by the action of light, heat and mainly by the pH of the medium.

U.S. Pat. No. 5,310,479 teaches a process for desulfurizing crude oil by means of an aqueous oxidant solution made up of formic acid and hydrogen peroxide. The oxidant is supposed to oxidize the aliphatic sulfur content of the crude oil. After the reaction the oil is washed with water to separate the oxidized products. The proposed technique is limited to aliphatic sulfur. In view of the incompatibility of water and crude oil, it is expected that much foam will be formed upon admixing of the aqueous oxidant solution and the crude oil. No mention is made to the removal of any nitrogen compound.

U.S. Pat. No. 6,406,616, already mentioned above, teaches a process for desulfurizing hydrocarbons such as gasoline and similar petroleum products to reduce the sulfur content to a range of from about 2 to 15 ppm sulfur without affecting the octane rating. The sulfur-containing hydrocarbon is contacted at slightly elevated temperatures with an oxidizing/extracting solution of formic acid, a small amount of hydrogen peroxide, and no more than about 25-wt % water. However, said U.S. patent is limited to fuel containing up to 500 ppm sulfur, that is why low (2–3%) $H_2O_2$ concentrations are used. FIG. 2 of this patent illustrates an alternative whereby an alumina adsorption step is proposed. Adsorption is directed to fulfill the removal of sulfur compounds, mainly oxidized thiophene compounds. Qualitative results ensuing sulfur removal after adsorption are not mentioned. In spite of stating that oxidized products contain of from 2 to 15 ppm sulfur, examples do not mention real figures for sulfur. Also, in spite of the fact that it is stated that the octane rating of the fuel is not affected by the oxidation, no octane rating measurement is provided. Also, said U.S. patent does not mention the reduction of non-sulfur substances contents, such as the nitrogen-containing compounds or others that may promote a troublesome unstable behavior and less-acceptable aspect of the hydrocarbon stream when used as feedstock of other refining process or as a final treated product.

Published U.S. Application No. 20020189975 of the Applicant and fully incorporated herein as reference, teaches the catalytic oxidation of organic compounds in a hydrophobic, fossil oil medium in the presence of a peracid (or peroxide/acid couple). The oxidation reaction is catalyzed by an iron oxide such as a pulverized limonite ore working as a highly dispersible source of catalytically active iron in this oil medium.

U.S. Ser. No. 10/314,963 of Dec. 09, 2002 of the Applicant and fully incorporated herein as reference, teaches the application of the peroxide/acid couple catalyzed by an iron oxide to a raw naphtha. The process is directed to the simultaneous oxidation and removal and/or inertization of the sulfur, nitrogen, conjugated dienes and other unsaturated compounds from said naphtha streams in the presence of said iron oxide catalyst.

Thus, the literature mentions processes for the treatment of a sulfur-containing fuel through oxidation in the presence of peracids (or peroxides and organic acids), or as in published application U.S. 20020189975A1, processes directed to the catalytic oxidation of organic compounds in a hydrophobic, fossil oil medium in the presence of a peracid (or peroxide/acid couple), the oxidation reaction being catalyzed by an iron oxide such as a pulverized limonite ore working as a highly dispersible source of catalytically active iron in this oil medium. However, there is no description nor suggestion in the literature of an auto-extractive oxidation of any heteroatomic polar compounds from raw hydrocarbon streams to remove specially high contents of nitrogen compounds while simultaneously removing and/or inertizating sulfur compounds to some extent aiming specially at minimizing strong harmful odor and color instability, whereby such compounds are oxidized in the presence of an aqueous peroxide solution/organic acid couple, the weight percent of the peroxide solution and organic acid based on raw naphtha being at least 3 for both peroxide solution and organic acid, said compounds being simultaneously removed from said streams by the oxidant itself, said process being described and claimed in the present invention.

SUMMARY OF THE INVENTION

Broadly, the present invention relates to a process for the extractive oxidation of sulfur and nitrogen, present in high amounts in raw hydrocarbon streams rich in heteroatomic polar compounds from fossil oils or from fossil fuel processing which enhances the polarity of said heteroatomic compounds, said oxidation and simultaneous aqueous extraction of the resulting oxidized compounds being effected in the presence of peroxide/organic acids.

The invention is directed to the simultaneous oxidation and removal and/or inertization of the sulfur and nitrogen compounds from said naphtha streams.

The process of the invention for the oxidation and/or inertization of sulfur and nitrogen compounds from raw hydrocarbon streams rich in heteroatomic polar compounds in the presence of a peroxide solution/organic acid couple at atmospheric pressure and equal or higher than ambient temperature, comprises the following steps:

a) Oxidizing sulfur and nitrogen compounds present in said raw hydrocarbon streams by admixing, under agitation, said organic acid and said peroxide, the weight percent of the peroxide solution and organic acid based on raw naphtha being at least 3 for both the peroxide solution and organic acid and then adding said raw hydrocarbon stream containing sulfur and nitrogen compounds, at a pH between 1.0 and 6.0, the reaction being carried out under reflux of vaporized hydrocarbon, for the period of time required to effect the extractive oxidation and obtaining a hydrocarbon stream wherefrom the sulfur and nitrogen compounds have been partially oxidized and simultaneously extracted by the oxidant solution, yielding a lower aqueous phase and an upper oxidized hydrocarbon phase;

b) After the end of said extractive oxidation, separating the upper hydrocarbon phase, neutralizing and water washing same, filtering and drying so as to obtain a treated, odorless, clear yellowish and stable hydrocarbon phase;

c) Recovering said treated, odorless, clear yellowish and stable hydrocarbon phase wherefrom the total nitrogen compounds have been removed up to 88.1 by weight or more, basic nitrogen compounds have been removed up to 99.1% by weight, sulfur compounds have been removed up to 23% by weight, while the removal of total olefins is limited to 6.5 weight %.

The treated product is a suitable feedstock that may be directed to any refining processes, such as hydrotreatment.

Sulfur compounds, which contaminate raw naphtha, are converted into oxidized compounds such as sulfoxides or sulfones, which are nearly odorless, and are partly removed by the aqueous oxidant mixture, leading to the removal of up to 23 weight % of such sulfur compounds.

Thus the present invention provides a process for the extractive oxidation and/or inertization of sulfur and nitrogen compounds from hydrocarbon streams through oxidation with peroxide/organic acid couple.

The present invention provides also a process for the simultaneous oxidation and removal (and/or inertization) of sulfur and nitrogen compounds from raw hydrocarbon streams through oxidation with peroxides and organic acids.

The present invention provides further a process for the extractive oxidation and/or inertization of sulfur and nitrogen compounds from raw hydrocarbon streams where the oxidized compounds have more affinity for an aqueous phase such as the oxidant than they have for the hydrocarbon phase.

The present invention provides still an extractive oxidation and/or inertization process for obtaining treated hydrocarbon streams suitable as feedstock for further refining processes such as hydrotreatment, since most of the catalysts harmful compounds have been removed.

The present invention provides further a self-extractive oxidation and/or inertization process for obtaining, from a hydrocarbon stream such as a raw naphtha contaminated with up to 0.1 weight % of basic N, 0.2 weight % total N and 1.0 weight % total S, treated, odorless and clarified naphtha streams having basic nitrogen contents less than 8 ppm, total nitrogen contents less than 250 ppm and total sulfur less than 0.7 weight %.

DETAILED DESCRIPTION OF THE INVENTION

Figure 1:
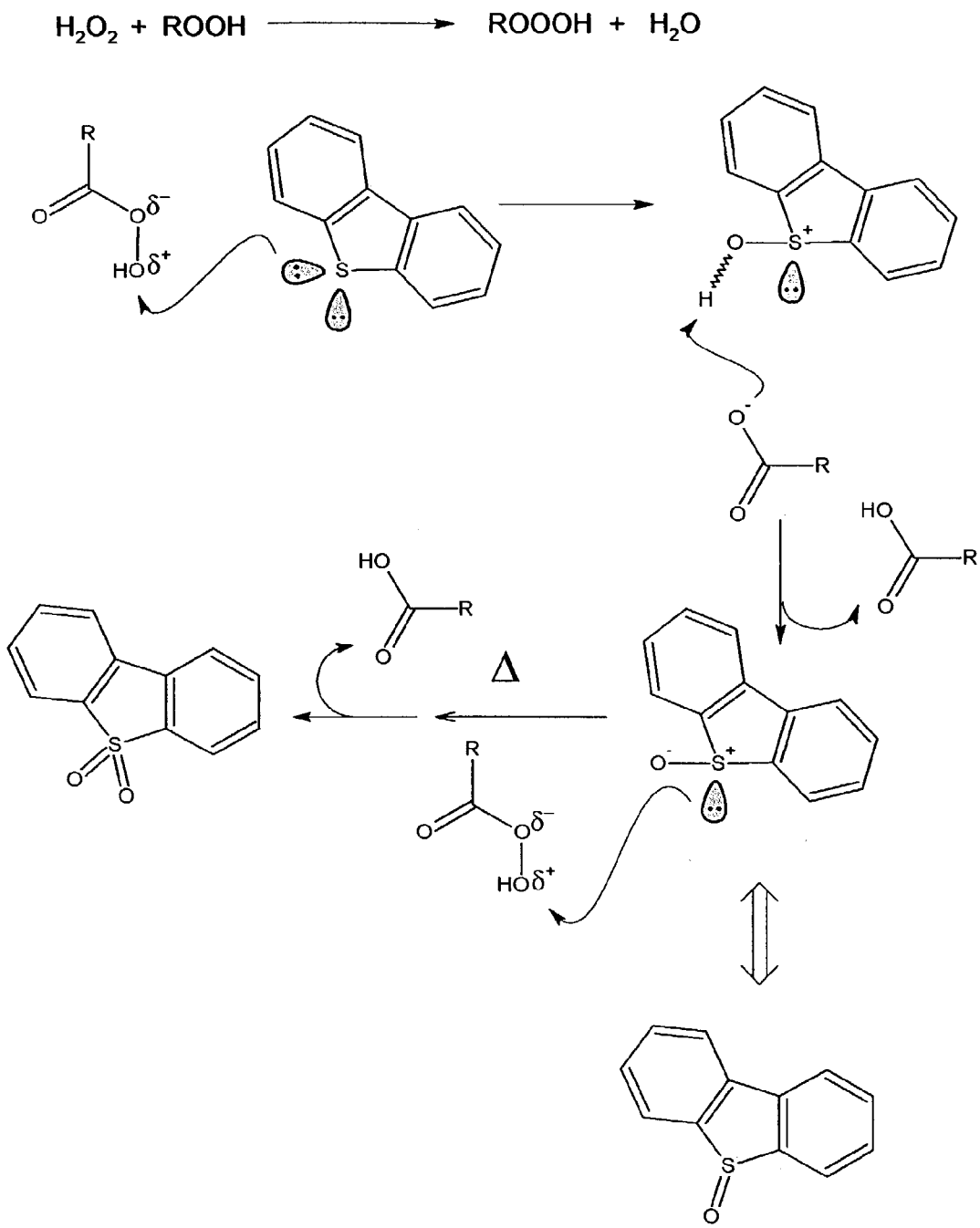
FIG. 1 attached illustrates the oxidation mechanism of a model sulfur compound such as dibenzothiophene that generates sulfoxides and sulfones, in the presence of hydrogen peroxide and an organic acid.
Figure 2:
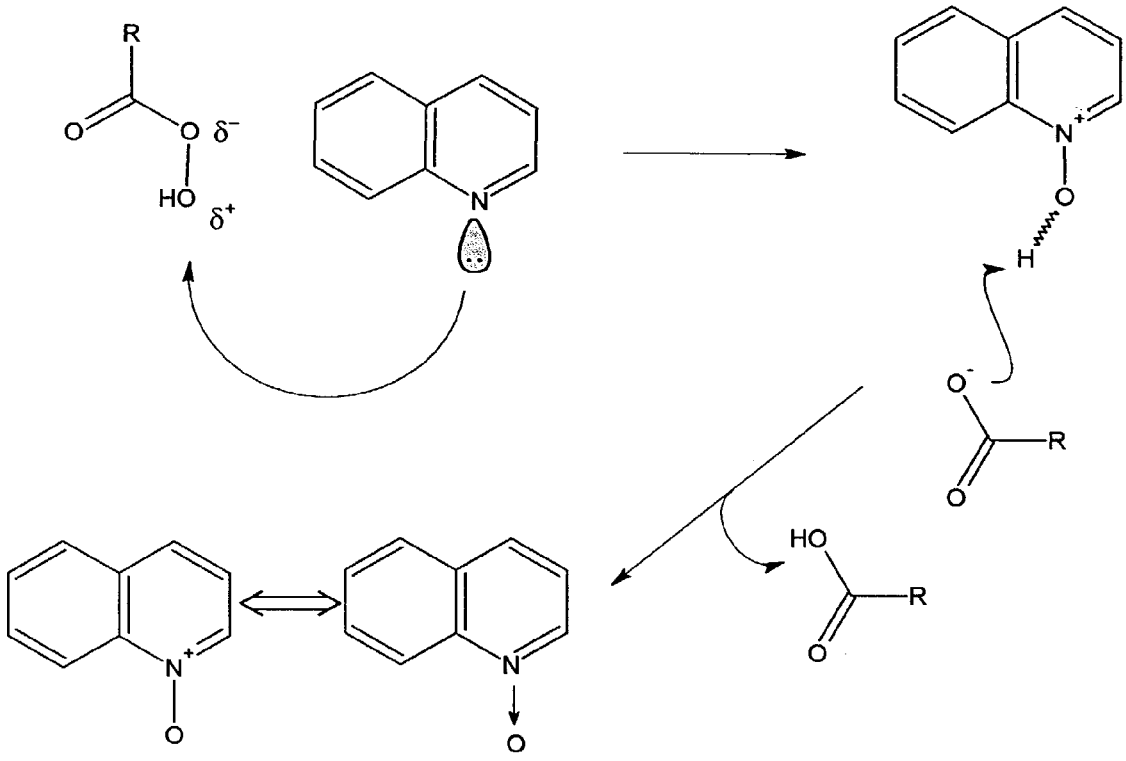
FIG. 2 attached illustrates the oxidation mechanism of a model nitrogen compound such as quinoline so as to generate the equivalent N-oxide and regenerate the organic acid.
Figure 3:
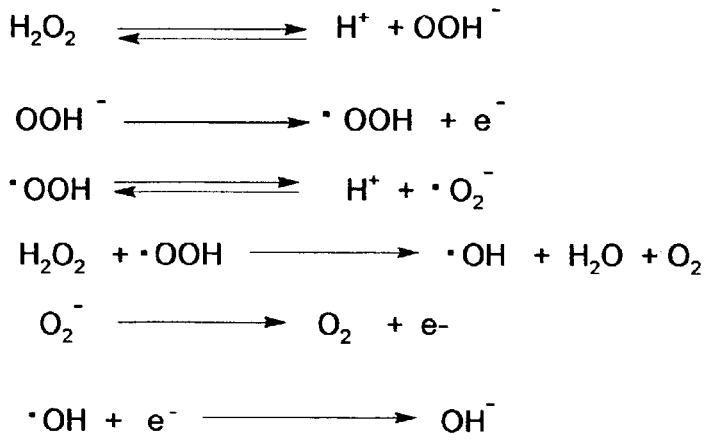
FIG. 3 attached illustrates the natural decomposition mechanism of hydrogen peroxide.

According to the invention, the expression "raw hydrocarbon" or "raw naphtha" means any hydrocarbon or naphtha stream rich in heteroatomic polar compounds and/or other unstable compounds, which has not been submitted to any hydrotreatment, Merox or caustic washing process.

Further, the expression "inertization" stands for converting compounds causing severe harmful odor into oxidized compounds of substantially attenuated odor. "Inertization" refers preferably to oxidized sulfur compounds remaining in the hydrocarbon stream since oxidized nitrogen compounds are almost totally removed.

It should be emphasized that naphtha streams with a severely harmful odor, such as those from shale oil retorting or delayed coking process, cause a negative environmental impact as well as suffer from severe commercial devaluation.

The present invention is based on the principle of the oxidation via the action of an in situ formed peracid from the same peroxide and the same acid, the weight percent of the peroxide solution and organic acid based on raw naphtha being at least 3 for both the peroxide solution and organic acid.

In the specific case of the present extractive oxidation process directed to raw hydrocarbons such as raw naphtha cuts from refining processes such as shale oil retorting, the contaminating substances oxidized through the use of such principles show a marked affinity for the oxidizing aqueous solution itself. This is why such oxidized compounds are easily and quickly extracted from the reaction medium.

Contrary to the state-of-the-art technique as stated for example in U.S. Pat. No. 6,406,616 B1, the present invention allows to dispense with operationally expensive steps such as the organic solvent extraction itself, including solvent regeneration and/or adsorption including adsorbent regeneration. Such steps usually cause a low overall process yield due to the several material losses throughout the process. In view of the cheaper and operationally easier steps of the present process, higher product yields are obtained.

In order to make easier the understanding of the principles of the present invention, the following paragraphs state the theoretical principles as well as laboratory implementation of same in a didactic manner.

Feedstock

The present process of extractive oxidation is useful for any raw hydrocarbon feed rich in heteroatomic polar compounds from refining processes, including any raw light and middle distillates.

One particular useful feedstock is raw naphtha obtained from shale oil retorting or other refining processes. Useful naphtha streams for the present process do not need to have been hydrotreated or sweetened. The boiling point range of these naphtha products is of from 30° C. to 300° C. Preferably the boiling range is of from 35° C. to 240° C. Sulfur contents extend up to 15,000 ppm, preferably of from around 7,000 to 9,000 ppm. Basic nitrogen contents extend up to 2,000 ppm. Total nitrogen contents extend up to 3,000 ppm. Olefin contents, more specifically open-chain or cyclic olefin compounds, for example, monoolefins, diolefins or polyolefins extend of from 10 to 40 weight %. Total aromatics contents extend of from 40 to 90 weight %. Conjugated dienes contents extend up to 3 mole/L.

Oxidant

The extractive oxidation process herein presented occurs by the combination of peroxide and an organic acid, the weight percent of the peroxide solution and organic acid based on raw naphtha being at least 3 for both the peroxide solution and organic acid.

The peroxide useful in the practice of the invention may be inorganic or organic.

Analogously to the peroxide, ozone may be used as well, alone or in admixture with the peroxide(s).

Preferably the inorganic peroxide is a hydroperoxide that may be the hydrogen peroxide $H_2O_2$.

Hydrogen peroxide is preferably employed as an aqueous solution of from 10% to 70% by weight $H_2O_2$ based on the weight of the aqueous hydrogen peroxide solution, more preferably containing of from 30% to 70% by weight $H_2O_2$.

The organic peroxide can be an acyl hydroperoxide of formula ROOH, where R═alkyl, $H_{n+2}C_nC(=O)$— (n>=1), Aryl-C (═O)—, HC (═O)—.

The organic acid is preferably a carboxylic acid RCOOH or its dehydrated anhydride form RC(═O)OC(═O)R, where R can be H, or $C_nH_{n+2}$ (n>=1) or $X_mCH_{3-m}COOH$ (m=1~3, X═F, Cl, Br), polycarboxylic acid -[R(COOH)—R(COOH)]$_{x-1}$— where (x>=2), or still a benzoic acid, or mixtures of same in any amount.

One preferred carboxylic acid is formic acid. Usually, formic acid is employed at a concentration ranging of from 85% to 100 weight %. The preferred formic acid is an analytical grade product, having concentration between 98–100 weight %.

Another preferred carboxylic acid is acetic acid. Usually, acetic acid is employed at a concentration ranging from 90% to 100 weight %.

The weight percent of the peroxide solution and organic acid based on raw hydrocarbon is at least 3 for both the peroxide solution and the organic acid. More preferably, the weight percent of the peroxide solution and organic acid is of from 6 to 15 for both the peroxide solution and the organic acid. It is not necessary that peroxide solution and organic acid amounts are the same. Higher weights percent depend on economic feasibility.

In view of the presence of acid in the reaction medium the pH of the medium is generally acidic, varying from 1.0 to 6.0, preferably 3.0.

The useful peroxide solution/organic acid molar ratio shall range from 0.5 to 1.2, preferably 0.9 to 1.1, or still more preferably 0.95 to 1.

After the oxidation the medium is neutralized at a pH 6.1–9.0 with the aid of a saturated $Na_2CO_3$ solution or of any other alkaline salt solution.

As will be shown later in the present specification by means of a comparative Example, the produced oxidized compounds show a slightly lower affinity for polar solvents than in the case the oils were treated with the peroxide-organic acid couple added of the iron oxide catalyst of U.S. Ser. No. 10/314,963 of Dec. 09, 2002.

Thus the process of the invention involves fundamentally an oxidation via the action of a peracid intermediate generated by the reaction of the peroxide with an organic acid.

As will be seen later in the present specification, researches conducted by the Applicant have led to the conclusion that the amounts of the constituents of the peroxide/organic acid couple employed in the oxidation yield an end product of lower contents in total sulfur and nitrogen compounds, mainly basic nitrogen compounds.

One-pot Reaction and Extraction

The extractive oxidation of the invention is a one-pot system. The produced oxidized compounds are extracted from the hydrocarbon medium by the aqueous phase as soon as formed, since the affinity of the aqueous phase and those compounds is enhanced upon oxidation.

As for the order of addition of the oxidizing compounds contemplated in the practice of the invention to the oxidizing and removal of S- and N-compounds from a raw hydrocarbon medium, the concept of the invention contemplates two main modes.

The previously admixed peroxide/organic acid couple is added to a mixture of raw hydrocarbon feedstock as defined above.

Alternatively, the hydrocarbon feedstock is added over the previously admixed peroxide/organic acid couple.

As for the reaction conditions, pressure is atmospheric or higher, while temperature extends from the ambient at the reaction start until a final temperature, which ranges from 60° C. to 80° C. by external heating, the duration of which is approximately 10 min to 30 minutes. After that, the reaction system is cooled until the end of total reaction time, which ranges from 1 hour to 1.5 hours.

The overall reaction is effected under vigorous stirring.

The reaction is carried out under reflux of vaporized hydrocarbon, the vaporization being due to the external reaction heating.

Otherwise, the reaction may be carried out under pressure to keep the hydrocarbon in liquid phase, this dispensing with reflux equipment.

The reactants are a dual-phase mixture, made up of a hydrocarbon phase comprising treated hydrocarbon and an aqueous phase comprising spent oxidant.

After the reaction completion, this mixture is cooled to ambient temperature and decanted to separate an aqueous phase from the hydrocarbon phase. The aqueous phase comprises the spent oxidant solution.

The hydrocarbon phase, the pH of which is usually in the range of 3–4, is neutralized to eliminate residual acidity remaining from the reaction medium. Preferred neutralizing agents are alkaline salt solutions, such as a $Na_2CO_3$, or a $Na_2SO_3$ solution. The pH of the neutralized hydrocarbon is in the range of 5–6, slightly less than neutral in order to avoid residual basicity from the alkaline solution, which may cause analytical misinterpretations during determination of basic nitrogen content, even if the neutralized hydrocarbon is additionally washed with distilled water to remove any residual salts.

The neutralized and washed hydrocarbon is then filtered and dried with the aid of any well-known drying procedure or means. For the sake of convenience the wastewater and waste alkaline neutralizing solutions may be recycled after being partially purged.

The aqueous solution mostly comprising organic acid may be either disposed off or reused. In the latter case, a small portion of said aqueous solution is purged and made up with fresh organic acid prior to reuse. The upper aqueous solution contains most of the oxidized and extracted material from the hydrocarbon, therefore the purged and make-up portions should be designed accordingly.

The purged liquid portions may be considered as part of the refinery acidic wastewater disposal.

Figure 4:
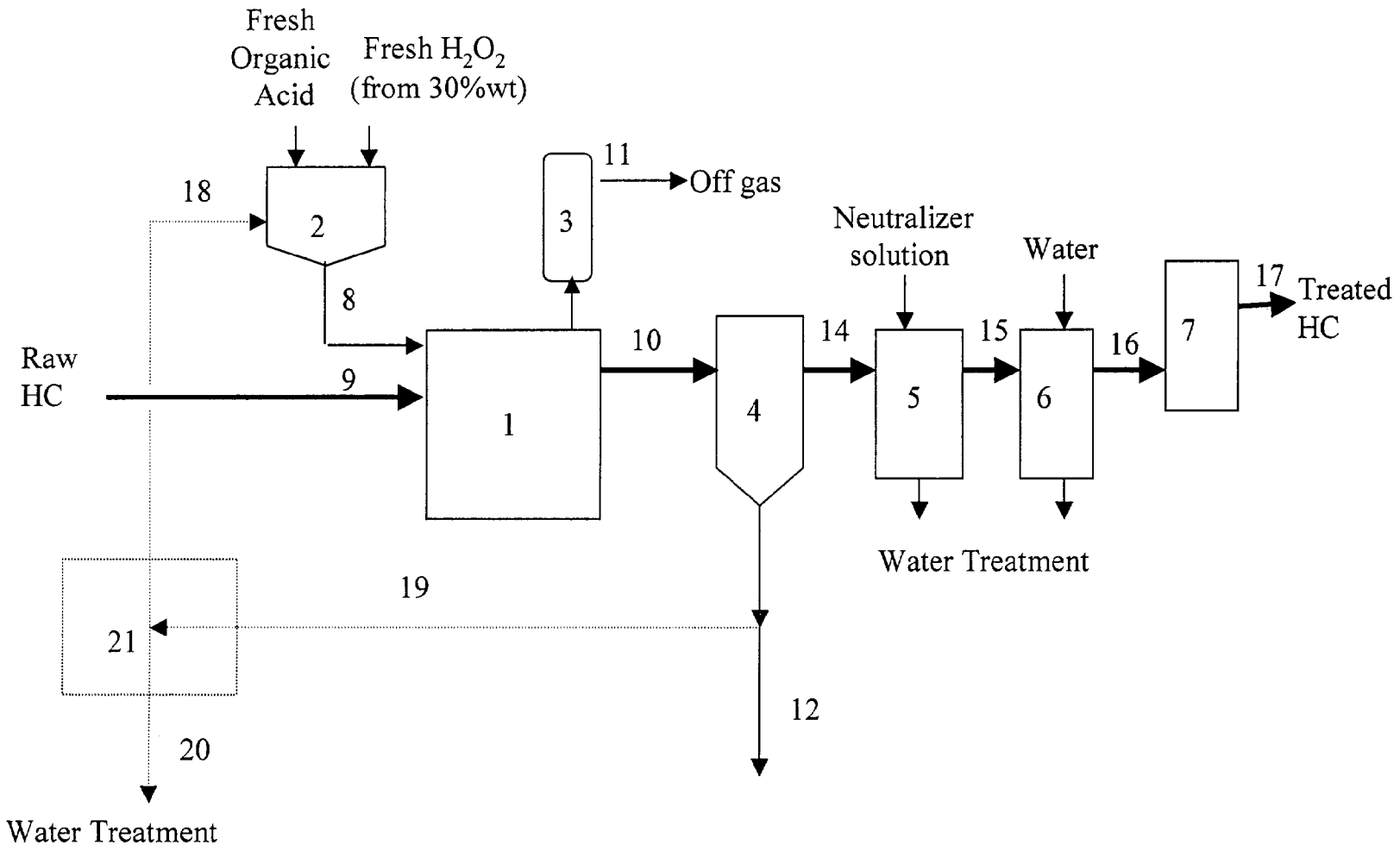
FIG. 4 attached is a proposed flowchart of the inventive process.

The invention is further illustrated by the schematic flowchart of FIG. 4.

Thus, into reactor 1, raw hydrocarbon is introduced via line 9. Tank 2 contains fresh peroxide solution and organic acid, to be directed to reactor 1 via line 8; to tank 2 is alternatively directed via line 18, a recycled portion of waste organic acid aqueous solution. The oxidation reaction takes place under reflux by means of condensation system 3, from which an off-gas stream is vented off via line 11. The oxidized mixture is directed via line 10 to decanter 4 where an aqueous phase is purged as waste acidic water via line 12 or alternatively recycled to tank 2 via line 18 after being partially purged via line 20. Another alternative is to concentrate the organic acid solution of line 19 at unit 21, by means of distillation or other appropriate process, prior to recycling to tank 2 via line 18, the separated water-rich portion being purged via line 20. The upper hydrocarbon phase from decanter 4 is directed via line 14 to block 5 where the oxidized hydrocarbon is neutralized with the aid of an alkaline solution and separated from the waste brine by decantation, the waste brine being sent to disposal. Neutralized hydrocarbon is directed via line 15 to water washer 6, where remaining salts are washed off the hydrocarbon stream, the wasted water being sent to disposal. Washed hydrocarbon is directed to dryer 7 via line 16. Treated hydrocarbon is collected via line 17.

The invention will now be illustrated by the following Examples, which should not be construed as limiting same.

EXAMPLES

The Examples below refer to the treatment being applied to raw naphtha cuts obtained from oil shale retorting.

Example 1

This Example illustrates an embodiment of the present invention.

To a 1 liter, three-necked, round-bottomed flask provided with a reflux condenser cooled with ethyl alcohol at −16° C. followed by a dry ice trapper of non refluxed hydrocarbon matter carried by non condensable gases, were added 500 ml of raw shale oil naphtha having a distillation range of 30° C. to 224° C. and containing 764.8 ppm basic nitrogen and 2,100 ppm total Nitrogen, 8,810 ppm total Sulfur and 27.8 weight % total olefins.

In a separate open flask, the oxidant solution containing 65 ml $H_2O_2$ 30% w/w and 24 ml formic acid analytical grade was agitated for 10 minutes at room temperature, until bubbles were given off.

The so-prepared oxidant solution was added to the contents of the reaction flask at a flow rate of 6.5 mL/min. After 7 minutes, an external source of heat was provided so as to allow the reaction temperature to stand in the interval of 60–70° C. for 30 minutes. Then the reaction temperature was allowed to decrease until room temperature naturally.

The total period of reactants inside reactor pot under vigorous stirring was nearly 50 minutes. Thus, the naphtha and aqueous phases are separated. The aqueous solution is discarded.

As a finishing treatment, the naphtha phase (pH=3–4) was neutralized with 200 ml of an aqueous 10% w/w $Na_2CO_3$ solution for 25 minutes under vigorous agitation. The aqueous and organic phases were then separated, and an additional 20 minutes were left for complete decanting of residual visible solid matter. The waste aqueous solution was discarded and the neutralized naphtha (pH=6–7) was collected.

The so-neutralized naphtha was washed with 100 mL of demineralized water and the phases were again separated. The so-washed naphtha was then dried and filtered over cotton and sent for analysis.

The yield of the so-obtained upgraded naphtha from this laboratorial batch experiment was 84.5% w/w plus 5–6% w/w attributed to naphtha losses due to evaporation during the bench experimental procedures. It should be pointed out that when operating in larger scale continuous process, it is expected that the said 5–6% w/w losses will not occur or if so, to a much reduced extent.

Experimental analysis of upgraded naphtha indicated 7.2 ppm basic Nitrogen (99.1% removal), 6,760 ppm total Sulfur (23.3% removal), total Nitrogen 250.0 ppm (88.1% removal) and total olefins contents of 26 weight % (6.5% removal).

Comparative Example 1

Table 1 below lists main differences between the extractive oxidation according to the present process and the extractive oxidation as proposed in U.S. Pat. No. 6,406,616.

The Applicant experiment (invention) involved a raw shale oil naphtha having a distillation range of 30° C. to 224° C. and containing 764.8 ppm basic nitrogen, 2,100 ppm total Nitrogen and 8,810 ppm total Sulfur. Reactant amounts relative to the feedstock are shown in Table 1 below as compared to equivalent ones of the referred to state-of-the-art document.

TABLE 1

| | Extractive Oxidation via Peracid Mechanism | | |
|---|---|---|---|
| | INVENTION | U.S. Pat. No. 6,406,616 Standard naphtha feed | U.S. Pat. No. 6,406,616 Synthetic naphtha feed |
| Reactants | | | |
| $H_2O_2$ solution, Concentration % w/w | 30.0 | 30.0 | 30.0 |
| $H_2O_2$ solution, % w/w, feed | 13.0 | 0.7 | 1.2 |
| $H_2O$ (sol. $H_2O_2$ + added) % v/v feed | 10.5 | 2.0 | 1.6 |
| HCOOH solution, Concentration % w/w | 85.0 | 96.0 | 96.0 |
| HCOOH solution, % v/v feed | 4.8 | 9.9 | 9.3 |
| Reaction | | | |
| Temperature | 63° C. | 65° C. | 90° C. |
| Pressure | 1 atm | 3 atm | 1.4 atm |

TABLE 1-continued

| | Extractive Oxidation via Peracid Mechanism | | |
|---|---|---|---|
| | INVENTION | U.S. Pat. No. 6,406,616 Standard naphtha feed | U.S. Pat. No. 6,406,616 Synthetic naphtha feed |
| Time | 10 min | 60 min | 60 min |
| Time quenching up to ambient T | 30 min | 30 min | 30 min |
| Post-reaction | | | |
| Neutralization | $Na_2CO_3$ | CaO | CaO |
| Filtration | Cotton filter | 0.45 micron filter | 0.45 micron filter |
| Feed | Shale oil raw naphtha | ASTM-Fuel-QCS-02 naphtha | Synthetic Gasoline |
| S total (ppm) | 8,810.0 | 336.0 | 600.0 |
| N total (ppm) | 2100.0 | NOT INFORMED | NOT INFORMED |
| N basic (ppm) | 764.8 | NOT INFORMED | NOT INFORMED |
| Olefins (% w/w) | 27.8 | 12.4 | 12.1 |
| Dienes (mol/L) | 2.3 | NOT INFORMED | NOT INFORMED |
| Product | Odorless clarified naphtha | | |
| S total (ppm) | 6760.0 | 237.0 | NOT INFORMED |
| N total (ppm) | 250.0 | NOT INFORMED | NOT INFORMED |
| N basic (ppm) | 7.2 | NOT INFORMED | NOT INFORMED |
| Olefins (% w/w) | 26.0 | NOT INFORMED | NOT INFORMED |
| Dienes (mol/L) | 2.2 | NOT INFORMED | NOT INFORMED |
| Removal (%) | | | |
| ΔS total | 23.3 | 29.5 | NOT INFORMED |
| ΔN total | 88.1 | NOT INFORMED | NOT INFORMED |
| ΔN basic | 99.1 | NOT INFORMED | NOT INFORMED |
| ΔOlefins | 6.5 | NOT INFORMED | NOT INFORMED |
| ΔDienes | 4.7 | NOT INFORMED | NOT INFORMED |
| Yield | 85% p/p feed | NOT INFORMED | NOT INFORMED |

Data from Table 1 show that the process of U.S. Pat. No. 6,406,616 is mainly directed to the removal of sulfur from slightly sulfur contaminated gasoline streams, that is, having sulfur contents not higher than 336 ppm as stated in experimental examples. This state-of-the-art process is not directed to the removal of nitrogen contaminants, especially those of highly contaminated raw naphthas with heteroatom hydrocarbon. The amount of hydrogen peroxide is low, since oxidation is meant to be mild.

Contrary to state-of-the-art processes, the present invention makes use of nearly equal molar amounts of peroxide and formic acid, avoiding peroxide dilution, this keeping a higher concentration of oxidizing agent.

It is to be noted that the amounts and relative proportions of peroxide and formic acid of the invention lead to the removal of heteroatomic compounds of raw naphthas without substantially affecting olefin contents. This is performed in spite of the high olefin contents present in the feed.

Comparative Example 2

A comparative Example was run to determine the extent of sulfur, nitrogen and diene contaminants removal from a sample of raw shale oil naphtha having a distillation range of 35° C. to 230° C. and containing 813.2 ppm basic nitrogen, 1,900 ppm total Nitrogen and 8,100 ppm total Sulfur and 2.37mol/L dienes, when submitted to the catalyst aided auto-extractive oxidation process of U.S. Ser. No. 10/314,963.

The sample of this shale oil raw naphtha was submitted to the extractive oxidation under an oxidant solution comprised of 40 ml $H_2O_2$ 50% w/w and 32 ml formic acid analytical grade and 3 g of dried limonite ore (−150 mesh Tyler). The experimental procedure was done accordingly with the iron oxide catalyst-aided procedure of the U.S. Ser. No. 10/314,963 process. The results are listed in Table 2 below in comparison with the results of the present invention in Example 1.

TABLE 2

| | Extractive Oxidation of Shale Oil Naphtha | |
|---|---|---|
| | $H_2O_2$/HCOOH/catalyst U.S. Ser. No. 10/314,963 | $H_2O_2$/HCOOH Invention |
| Basic ΔN % | 99.4 | 98.0 |
| Total ΔN % | 90.0 | 76.7 |
| Δdienes % | 21.5 | 4.7 |
| Total ΔS % | 12.5 | 23.3 |

Data from Table 2 show that the extractive oxidation carried out on samples of hydrocarbon streams of which it is desired to strongly reduce basic nitrogen contents as well as total nitrogen according to the invention are a reliable alternative to state-of-the-art processes for the removal of said nitrogen contaminants.

Table 2 also shows that the removal of sulfur contaminants according to the invention is deeper than sulfur removal by the catalyst-aided version of U.S. Ser. No. 10/314,963. In spite of a slightly lower total nitrogen removal of the invention as compared to U.S. Ser. No. 10/314,963, the obtained figures are still at a highly acceptable level.

Therefore, as shown by the preceding, all the operations performed according to the present invention, as compared to U.S. Ser. No. 10/314,963, are simpler to perform since there is no solid manipulation involved, causing the end product to have nitrogen contents quite acceptable for instance as a feedstock for further treating processes.

We claim:

1. A process for the extractive oxidation of contaminants from raw hydrocarbon streams, rich in heteroatomic polar compounds, by oxidation of sulfur, nitrogen, conjugated dienes and other unsaturated compounds in the presence of a peroxide/organic acid couple, wherein said process comprises the following steps:

a) providing an aqueous solution of a peroxide/organic acid couple;

b) oxidizing sulfur and nitrogen compounds present in said raw hydrocarbon streams by admixing, under vigorous stirring, said aqueous solution, thereby obtaining an oxidant solution, the weight percent of the peroxide and organic acid based on raw hydrocarbon being at least 3 for both the peroxide and the organic acid, at a pH between 1.0 and 6.0, under a temperature ranging from ambient temperature at the start of the reaction to a final temperature of 60 to 80° C., which is achieved by external heating, for a period of time required to effect the auto extraction oxidation reaction and obtaining a hydrocarbon stream wherefrom mainly sulfur and nitrogen compounds have been partially oxidized and simultaneously extracted by the aqueous oxidant, yielding a lower aqueous phase and an upper oxidized hydrocarbon phase;

c) separating the upper oxidized hydrocarbon phase, neutralizing and water washing same, filtering and drying;

d) recovering treated, odorless, clear yellowish and stable hydrocarbon phase wherefrom the total nitrogen compounds have been removed up to 88.1% by weight, basic nitrogen compounds have been removed up to 99.1% by weight, and sulfur compounds have been removed up to 23% by weight, followed by olefin removal limited to 6.5 weight %, all percentages being based on the original feedstock content.

2. A process according to claim 1, wherein the treated hydrocarbon phase is further directed to a refining process.

3. A process according to claim 2, wherein the refining process is a hydrotreating process.

4. A process according to claim 1, wherein alternatively the so-prepared oxidant solution is added to the raw hydrocarbon.

5. A process according to claim 1, wherein the raw hydrocarbon feed is any raw light and middle distillate.

6. A process according to claim 5, wherein the raw hydrocarbon feed includes raw naphthas from thermal processes such as delayed coking.

7. A process according to claim 5, wherein the raw hydrocarbon feed includes raw naphthas from fluid catalytic cracking.

8. A process according to claim 5, wherein the raw hydrocarbon feed includes raw naphthas from shale oil retorting processes or other chemical processes.

9. A process according to claim 6, wherein the raw naphtha is obtained from oil shale retorting.

10. A process according to claim 1, wherein the peroxide is added as such or in solution.

11. A process according to claim 10, wherein the peroxide is hydrogen peroxide at a concentration of at least 30 weight %.

12. A process according to claim 10, wherein the hydrogen peroxide concentration is 50 weight %.

13. A process according to claim 10, wherein the hydrogen peroxide concentration is 60 weight %.

14. A process according to claim 1, wherein the extractive oxidation of heteroatomic polar compounds from said raw hydrocarbon stream comprises said oxidized compounds, as a result of the strong affinity of same for the aqueous phase, being extracted into said phase by the aqueous oxidant itself.

15. A process according to claim 1, wherein the organic acid is formic acid.

16. A process according to claim 1, wherein the organic acid is acetic acid.

17. A process according to claim 1, wherein the weight percent of the peroxide solution and organic acid based on the raw hydrocarbon is of from 6 to 15 for both the peroxide and the organic acid.

18. A process according to claim 17, wherein there is a difference in weight percents between the peroxide solution and organic acid solution.

19. A process according to claim 1, wherein the peroxide/organic acid molar ratio is in the range of from 0.5 to 1.2.

20. A process according to claim 19, wherein said molar ratio is in the range of from 0.9 to 1.1.

21. A process according to claim 20, wherein said molar ratio is in the range of from 0.95 to 1.

22. A process according to claim 1, wherein the waste aqueous phase, waste alkaline neutralizing and wastewater solutions are completely purged.

23. A process according to claim 1, wherein alternatively the waste aqueous phase and waste alkaline neutralizing solutions are partially recycled.

24. A process according to claim 1, wherein alternatively the organic acid-rich waste aqueous phase is concentrated and recycled to the reaction tank.

25. A process according to claim 5, wherein the raw hydrocarbon feed is raw naphtha of boiling range of from 30° C. to 300° C.

26. A process according to claim 6, wherein the raw hydrocarbon feed is raw naphtha of boiling range of from 30° C. to 300° C.

27. A process according to claim 7, wherein the raw hydrocarbon feed is raw naphtha of boiling range of from 30° C. to 300° C.

28. A process according to claim 8, wherein the raw hydrocarbon feed is raw naphtha of boiling range of from 30° C. to 300° C.

* * * * *